United States Patent [19]

Mayer

[11] 4,178,702

[45] Dec. 18, 1979

[54] GOLF-SHOE SOLE

[75] Inventor: Hubert J. M. Mayer, Marly, Switzerland

[73] Assignee: Bata-Schuh-Aktiengesellschaft, Riburg, Switzerland

[21] Appl. No.: 862,394

[22] Filed: Dec. 20, 1977

[30] Foreign Application Priority Data

Dec. 22, 1976 [CH] Switzerland ..... 16190/76

[51] Int. Cl.[2] ..... A43C 15/02; A43B 5/00

[52] U.S. Cl. ..... 36/59 R; 36/67 D; 36/127

[58] Field of Search ..... 36/59 R, 59 A, 32 R, 36/127, 67 R, 67 D

[56] References Cited

U.S. PATENT DOCUMENTS

| | | | |
|---|---|---|---|
| 825,869 | 7/1906 | Sandeman | 36/59 R |
| 1,422,716 | 7/1922 | Jones | 36/127 X |
| 2,316,601 | 4/1943 | Larkin | 36/59 A |
| 3,337,971 | 8/1967 | Rose | 36/127 |
| 3,782,011 | 1/1974 | Fisher | 36/59 R |
| 3,918,181 | 11/1975 | Inohara | 36/59 C |
| 4,083,126 | 4/1978 | Pelletier | 36/67 D |

FOREIGN PATENT DOCUMENTS

| | | | |
|---|---|---|---|
| 2202934 | 7/1973 | Fed. Rep. of Germany. | |
| 2443283 | 3/1976 | Fed. Rep. of Germany. | |
| 2535624 | 7/1976 | Fed. Rep. of Germany | 36/67 D |
| 276701 | 10/1951 | Switzerland | 36/59 R |
| 563738 | 7/1975 | Switzerland | 36/127 |

*Primary Examiner*—James Kee Chi

*Attorney, Agent, or Firm*—Pearne, Gordon, Sessions

[57] ABSTRACT

A golf-shoe sole made of polyurethane-base foamed material is provided with spikes; but in a spike-free zone located in the region to be occupied by the ball of a wearer's foot there are at least two volcano-shaped elevations the inner and outer surfaces of each such elevation intersecting at a circular rim situated approximately 3 mm below the base and having a diameter from 10 to 12 mm.

3 Claims, 3 Drawing Figures

GOLF-SHOE SOLE

This invention relates to golf-shoe soles of the type made of polyurethane-base foamed material and having spikes.

Conventional golf-shoe soles of this type are provided with spikes also in the region of the ball of the foot, so that there are hard spots in this region. Moreover, since golfers often turn on the balls of their feet when taking up their stance when playing, the green is often torn up by these spikes.

It is an object of this invention to provide an improved golf-shoe sole of the aforementioned type in which walking comfort is increased by the absence of any hard spikes in the region of the ball of the foot, which nevertheless affords adequate ground traction, and which does not destroy the green.

To this end, in the golf-shoe sole according to the present invention, the improvement comprises a spike-free transverse zone situated at a location intended to be occupied by the ball of a wearer's foot, and two or more volcano-shaped elevations disposed in that zone each of the elevations having a base, a conical outer surface, and a cup-shaped central depression, the apex angle of the conical outer surface being approximately 90°, and the outer surface intersecting with the surface of the depression to form a circular rim from 10 to 12 mm in diameter situated approximately 3 mm below the base.

Preferred embodiments of the invention will now be described in detail with reference to the accompanying drawing, in which.

Figure 1:
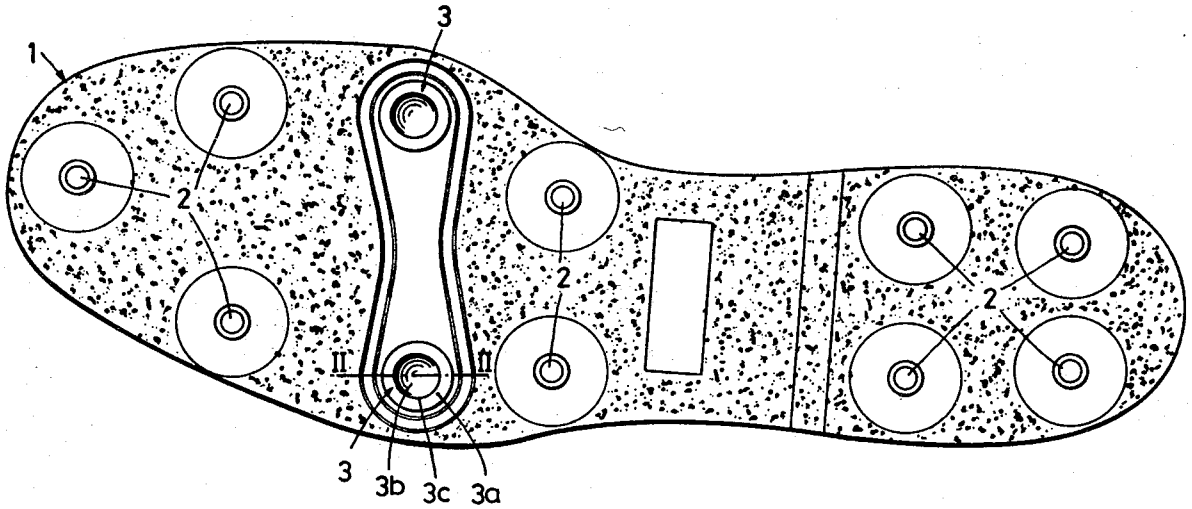
FIG. 1 is a plan view of the underside of a sole.
Figure 2:
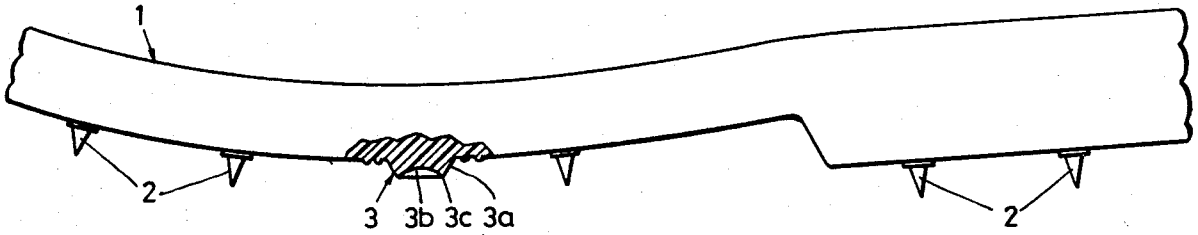
FIG. 2 is an elevation corresponding to FIG. 1, partially in section taken on the line II—II of FIG. 1.

FIGS. 1 and 2 illustrate a golf-shoe sole 1, made of a polyurethane-base foamed material, having spikes 2. In a transverse zone situated in the region of the ball of the foot, however, there are no spikes, but rather two—there might possibly be three—volcano-shaped elevations 3, the conical outer surfaces 3*a* of which each have an apex angle of about 90°, and the depression surfaces 3*b* of which are cup-shaped, the surfaces 3*a* and 3*b* intersecting at a circular rim 3*c* having a diameter of 10 to 12 mm and situated about 3 mm below the base of the elevation 3.

In the embodiment of FIG. 2, the elevations 3 are formed in one piece with the sole 1 and are made of the same material as the sole 1.

Figure 3:
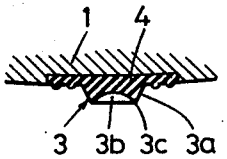
FIG. 3 is a partial section, analogous to that of FIG. 2 of a further embodiment.

In the modified embodiment shown in FIG. 3, the two (or possibly three) elevations 3 are, together with a base patch 4 adhesively affixed to the sole 1 and joining the elevations 3, made of rubber. The base patch 4 may, as shown in FIG. 3, lie in a suitably deep recess in the sole 1, or it may instead be cemented simply to the virtually flat surface of the sole 1.

What is claimed is:

1. In a golf-shoe sole of the type made of polyurethane-base foamed material and having spikes, the improvement comprising:

a spike-free transverse zone situated at a location intended to be occupied by the ball of a wearer's foot, and two or more volcano-shaped elevations disposed in said zone, each of said elevations having a base, a conical outer surface, and a cup-shaped central depression, the apex angle of said conical outer surface being approximately 90°, and said outer surface intersecting with the surface of said depression to form a circular rim from 10 to 12 mm in diameter situated approximately 3 mm below said base.

2. A golf-shoe sole in accordance with claim 1, wherein said elevations are made in one piece with said sole and are of the same said material.

3. A golf-shoe sole in accordance with claim 1, further comprising a rubber patch adhesively affixed to said sole, wherein said elevations are made of rubber and are joined to one another by said patch.

* * * * *